US009162689B2

(12) United States Patent
Itagaki et al.

(10) Patent No.: US 9,162,689 B2
(45) Date of Patent: Oct. 20, 2015

(54) ESTIMATED TRAIN OCCUPANCY RANGE DETERMINATION DEVICE, ONBOARD SYSTEM, AND ESTIMATED TRAIN OCCUPANCY RANGE DETERMINATION METHOD

(71) Applicant: KYOSAN ELECTRIC MFG. CO., LTD., Yokohama, Kanagawa (JP)

(72) Inventors: Tomonori Itagaki, Kawasaki (JP); Fumio Hashimoto, Yokohama (JP); Tamotsu Yokoyama, Yokohama (JP); Toshifumi Nishi, Yokohama (JP)

(73) Assignee: KYOSAN ELECTRIC MFG. CO., LTD., Yokohama-Shi, Kanagawa (JP)

( * ) Notice: Subject to any disclaimer, the term of this patent is extended or adjusted under 35 U.S.C. 154(b) by 134 days.

(21) Appl. No.: 13/960,900

(22) Filed: Aug. 7, 2013

(65) Prior Publication Data

US 2014/0117168 A1 May 1, 2014

Related U.S. Application Data

(63) Continuation of application No. PCT/JP2012/077682, filed on Oct. 26, 2012.

(51) Int. Cl.

| | |
|---|---|
| ***B61L 1/02*** | (2006.01) |
| ***B61L 1/10*** | (2006.01) |
| ***B61L 3/12*** | (2006.01) |
| *B61L 25/02* | (2006.01) |
| *B61L 1/16* | (2006.01) |
| *B61L 27/00* | (2006.01) |

(52) U.S. Cl.

CPC ... *B61L 1/02* (2013.01); *B61L 1/10* (2013.01); *B61L 3/125* (2013.01); *B61L 1/16* (2013.01); *B61L 25/025* (2013.01); *B61L 27/0077* (2013.01)

(58) Field of Classification Search

CPC ..... B61L 1/00; B61L 1/02; B61L 1/14; B61L 21/00; B61L 21/04; B61L 21/06; B61L 21/065; B61L 21/08; B61L 21/10; B61L 25/00; B61L 25/02; B61L 25/021

USPC ..... 246/2 R–4, 20, 21, 23, 27, 28 R, 122 R, 246/123, 131, 132, 167 R, 177, 178

See application file for complete search history.

(56) References Cited

U.S. PATENT DOCUMENTS

2005/0133673 A1* 6/2005 Sugita et al. ..... 246/167 R

FOREIGN PATENT DOCUMENTS

| | | |
|---|---|---|
| JP | 2005-178667 A | 7/2005 |
| JP | 2007-331629 A | 12/2007 |

(Continued)

OTHER PUBLICATIONS

International Search Report of the International Searching Authority mailed Jan. 15, 2013 for the corresponding international application No. PCT/JP2012/077682.

*Primary Examiner* — R. J. McCarry, Jr.

(74) *Attorney, Agent, or Firm* — Muncy, Geissler, Olds & Lowe, P.C.

(57) ABSTRACT

An onboard system measures the train position by measuring the rotational speed of a tacho-generator, determines an estimated train occupancy range (in which the train may be present) using the train position, and transmits the estimated train occupancy range to a ground system. The onboard system corrects the train position based on the results of communication with a correction coil when the train has passed through the installation point of a correction coil. When the train position has been shifted backward as a result of correction that utilizes the correction coil, the onboard system determines and transmits the estimated train occupancy range based on the train position immediately before correction until the latest train position reaches the train position immediately before correction, and determines and transmits the estimated train occupancy range based on the latest train position after the latest train position has reached the train position immediately before correction.

7 Claims, 9 Drawing Sheets

(56) References Cited

FOREIGN PATENT DOCUMENTS

| | | | |
|---|---|---|---|
| JP | 2008-126721 | A | 6/2008 |
| JP | 4575807 | B2 | 8/2010 |
| JP | 2010-241281 | A | 10/2010 |

* cited by examiner

[ESTIMATED TRAIN OCCUPANCY RANGE]

[OCCUPANCY DETERMINATION]

(1)BEFORE CORRECTION (2)AFTER CORRECTION

ESTIMATED TRAIN OCCUPANCY RANGE DETERMINATION DEVICE, ONBOARD SYSTEM, AND ESTIMATED TRAIN OCCUPANCY RANGE DETERMINATION METHOD

CROSS REFERENCE TO RELATED APPLICATION

This application is a continuation of International Patent Application No. PCT/JP2012/077682, having an international filing date of Oct. 26, 2012, which designated the United States, the entirety of which is incorporated herein by reference.

BACKGROUND

The present invention relates to an estimated train occupancy range determination device that determines an estimated train occupancy range in which a train may be present.

In recent years, development of the Communications-Based Train Control (CBTC) system that does not require a track circuit has progressed. The CBTC system is configured so that an onboard system measures position information about the train, and transmits the position information to a ground system via wireless communication, and the ground system detects the position of the train based on the position information to control the train.

The onboard system determines the train position by measuring the rotational speed of a tacho-generator attached to the axle, for example, and the measured train position contains a measurement error. A technique that utilizes a range obtained by adding a margin distance (train length correction value) to the actual train length when detecting occupancy using the ground system has been proposed (see Japanese Patent No. 4575807, for example).

A technique has been generally used that corrects the train position based on the installation position (absolute position) of a correction coil acquired through communication with the correction coil when the train passes through the correction coil provided along the track in order to reduce a measurement error of the train position measured by the onboard system.

When correcting the train position by utilizing the correction coil, however, the train position may change (i.e., may be shifted forward/backward) due to correction. The ground system of the CBTC system determines whether or not each block section is occupied by a train based on the train position received from the onboard system. However, a change in train position due to correction may pose a problem when determining whether or not each block section is occupied by a train.

Specifically, when the train position measured by the onboard system precedes the actual train position, the train position is corrected backward when the train has passed through the correction coil. For example, when the rear end of the train that has been present within a second block section that follows a first block section is returned to the first block section due to backward correction, it is determined that the first block section is unoccupied before correction, and occupied after correction. Specifically, the first block section that has been detected to be unoccupied by the train that travels forward is occupied by the train again. In this case, the following train that is entering the first block section must be stopped rapidly since the following train is not allowed to enter the first block section. The above problem also occurs when the train position is corrected forward.

SUMMARY

According to one aspect of the invention, there is provided an estimated train occupancy range determination device that determines an estimated train occupancy range in which a train may be present, the train including a measurement section that measures a train position, a correction coil communication section that communicates with a correction coil when the train passes through an installation point of the correction coil, and a correction section that corrects the train position based on a communication result of the correction coil communication section, the estimated train occupancy range determination device comprising:

a detection section that detects whether or not the train position has been corrected backward; and a determination section that determines the estimated train occupancy range using the train position, the determination section maintaining the estimated train occupancy range when the detection section has detected that the train position has been corrected backward until a latest train position reaches the train position immediately before the train position is corrected backward.

According to another aspect of the invention, there is provided an estimated train occupancy range determination method that determines an estimated train occupancy range in which a train may be present, the train including a measurement section that measures a train position, a correction coil communication section that communicates with a correction coil when the train passes through an installation point of the correction coil, and a correction section that corrects the train position based on a communication result of the correction coil communication section, the estimated train occupancy range determination method comprising:

detecting whether or not the train position has been corrected backward;

determining the estimated train occupancy range using the train position; and maintaining the estimated train occupancy range when it has been detected that the train position has been corrected backward until a latest train position reaches the train position immediately before the train position is corrected backward.

DESCRIPTION OF EXEMPLARY EMBODIMENTS

Figure 1:
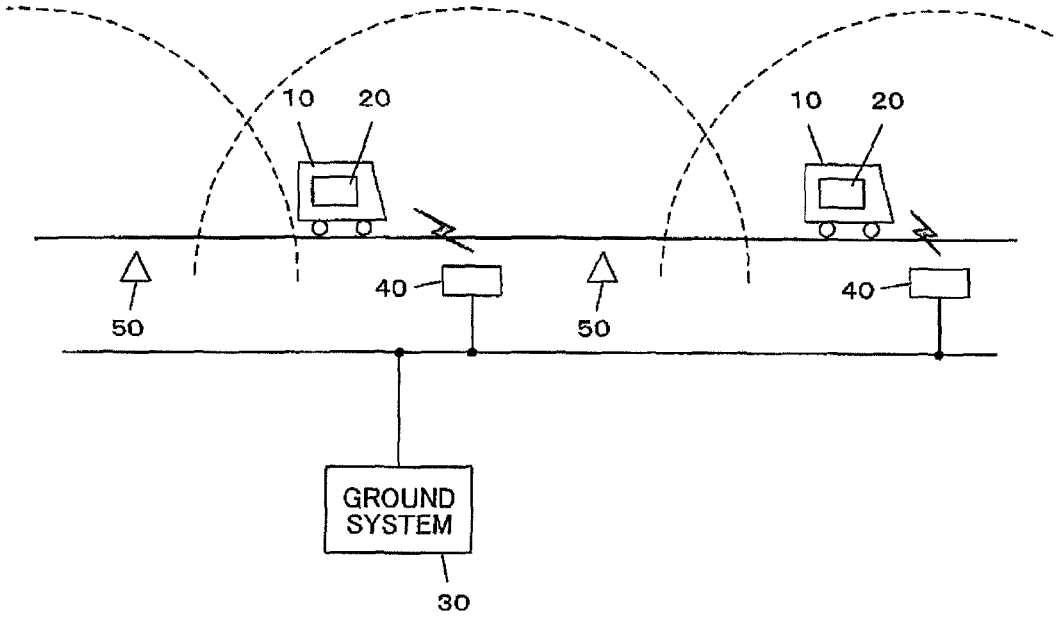
FIG. 1 is a view illustrating the configuration of a train position detection system.

According to one embodiment of the invention, there is provided an estimated train occupancy range determination device that determines an estimated train occupancy range in which a train may be present, the train including a measurement section that measures a train position, a correction coil communication section that communicates with a correction coil when the train passes through an installation point of the correction coil, and a correction section that corrects the train position based on a communication result of the correction coil communication section, the estimated train occupancy range determination device comprising:

a detection section that detects whether or not the train position has been corrected backward; and a determination section that determines the estimated train occupancy range using the train position, the determination section maintaining the estimated train occupancy range when the detection section has detected that the train position has been corrected backward until a latest train position reaches the train position immediately before the train position is corrected backward.

According to another embodiment of the invention, there is provided an estimated train occupancy range determination method that determines an estimated train occupancy range in which a train may be present, the train including a measurement section that measures a train position, a correction coil communication section that communicates with a correction coil when the train passes through an installation point of the correction coil, and a correction section that corrects the train position based on a communication result of the correction coil communication section, the estimated train occupancy range determination method comprising:

detecting whether or not the train position has been corrected backward;

determining the estimated train occupancy range using the train position; and maintaining the estimated train occupancy range when it has been detected that the train position has been corrected backward until a latest train position reaches the train position immediately before the train position is corrected backward.

According to the above configuration, when the train position has been corrected backward through communication with the correction coil, the estimated train occupancy range is maintained until the latest train position reaches the train position immediately before correction. This means that the estimated train occupancy range is not shifted backward even if the train position has been corrected backward. This prevents a situation in which the estimated train occupancy range is shifted across the boundary between the block sections even if the train position has been shifted backward due to correction that utilizes the correction coil, when utilizing the estimated train occupancy range for occupancy determination.

In one of the above estimated train occupancy range determination device, the determination section may include:

a storage control section that stores the train position when the detection section has detected that the train position has not been corrected backward, and does not store the latest train position when the detection section has detected that the train position has been corrected backward until the latest train position reaches the train position immediately before the train position is corrected backward; and a calculation section that calculates the estimated train occupancy range based on the train position stored by the storage control section.

According to the above configuration, the train position is stored when the train position has not been corrected backward, and is not stored when the train position has been corrected backward until the latest train position reaches the train position immediately before correction. The estimated train occupancy range is calculated based on the stored train position.

In one of the above estimated train occupancy range determination device, the determination section may include:

a calculation section that calculates the estimated train occupancy range as a provisional range based on the train position; and a storage control section that stores the provisional range when the detection section has detected that the train position has not been corrected backward, and does not store the provisional range when the detection section has detected that the train position has been corrected backward until the latest train position reaches the train position immediately before the train position is corrected backward, the determination section may set the provisional range stored by the storage control section to be the estimated train occupancy range.

According to the above configuration, the provisional estimated train occupancy range is calculated based on the train position. The provisional range is stored when the train position has not been corrected backward, and is not stored when the train position has been corrected backward until the latest train position reaches the train position immediately before correction. The provisional range thus stored is used as the estimated train occupancy range.

In one of the above estimated train occupancy range determination device, the detection section may detect whether or not the train position has been corrected backward based on a change direction of the train position.

According to the above configuration, the backward correction of the train position is detected based on the change direction of the train position.

In one of the above estimated train occupancy range determination device, the determination section may calculate a margin distance that allows a measurement error of the measurement section based on a travel distance after the train has passed through the installation point, and may determine a length of the estimated train occupancy range using the margin distance and a total length of the train.

According to the above configuration, the length of the estimated train occupancy range is determined using the total length of the train and the margin distance that allows for a measurement error. The margin distance is calculated based on the travel distance after the train has passed through the installation point of the correction coil. It is considered that a measurement error of the train position is small immediately after the train has passed through the installation point of the correction coil, and increases as the travel distance after the train has passed through the installation point of the correction coil increases. This makes it possible to absorb a measurement error by utilizing the margin distance, and prevent a situation in which the estimated train occupancy range unnecessarily increases.

According to embodiment aspect of the invention, there is provided an onboard system comprising:

a measurement section that measures a train position;

a correction coil communication section that communicates with a correction coil when a train passes through an installation point of the correction coil;

a correction section that corrects the train position based on a communication result of the correction coil communication section;

the estimated train occupancy range determination device as defined in any one of claims 1 to 5; and a transmission control section that transmits the estimated train occupancy range determined by the estimated train occupancy range determination device to a ground system that manages a position occupied by a train.

According to the above configuration, it is possible to implement an onboard system that achieves the above advantageous effects.

Exemplary embodiments of the invention are described below with reference to the drawings. Note that the invention is not limited to the following exemplary embodiments.

Outline

FIG. 1 illustrates an outline of a train position detection system 1 according to one embodiment of the invention. The train position detection system 1 detects whether or not each virtual block section obtained by virtually dividing a track is occupied by a train. The train position detection system 1 includes an onboard system 20 that is mounted on a train 10, and a ground system 30. The onboard system 20 and the ground system 30 can communicate with each other via wireless communication through a given communication channel including a wireless base station 40. A plurality of wireless base stations 40 are provided along a track R so that the track R is continuously included in the wireless communication area.

Note that the communication channel may be implemented using a loop antenna or a leakage coaxial cable (LCX cable) provided along the track R instead of using the wireless base station 40.

The onboard system 20 detects the position of the train 10 to generate train position information that indicates the position of the train 10, and transmits the train position information to the ground system 30 together with train identification information (e.g., train ID) about the train 10. The train position may be indicated by the distance (km) from the starting point along the track, or may be indicated by the distance from the nearest station along the track. It is advantageous that the train position information be indicated by the distance from a given position along the track.

The onboard system 20 corrects the train position when the train 10 has passed through a correction coil 50 that is a position correction track antenna provided along the track R based on wireless communication with the correction coil 50. The correction coil 50 may be configured using a transceiver coil in the same manner as a known track antenna, or may be configured using radio frequency identification (RFID). The onboard system 20 and the correction coil 50 communicate with each other via short-range wireless communication.

The ground system 30 manages whether or not each block section is occupied by the train 10 based on the train position information received from the onboard system 20.

The following description is given taking a double-track railway as an example while focusing on one of the tracks for convenience of explanation. Note that the invention may also be applied to a single-track railway, a four-track railway, and the like.

Principle (A) Onboard Position Detection

Figure 2:
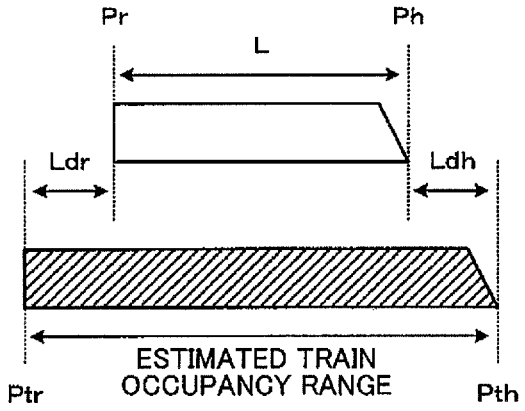
FIG. 2 is a view illustrating an estimated train occupancy range.

The onboard system 20 detects the train position as described below. FIG. 2 is a view illustrating a train position detection process implemented by the onboard system 20. The onboard system 20 determines the train position by measuring the rotational speed of the wheel set, the axle, or the wheel that is detected using a tacho-generator, an axle pulse sensor, or the like. An example in which the rotational speed is detected using a tacho-generator is described below. Since the tacho-generator is provided at a fixed position, the relative distances from the front end and the rear end of the train are constant. Therefore, the front end position Ph and the rear end position Pr of the train 10 are calculated from the measured train position and the relative distances. In one embodiment of the invention, the front end position Ph is used as the train position. Note that the rear end position Pr may also be used as the train position. Since the train has a constant train length L, the rear end position Pr is situated backward from the train position (front end position) Ph by the train length L.

A range calculated by adding a margin distance to the range specified by the positions Ph and Pr is set to be an estimated train occupancy range in which the train 10 may be present, taking account of a measurement error due to the tacho-generator or the like. Specifically, the onboard system 20 calculates a position Pth situated forward from the train position (front end position) Ph by a forward margin distance Ldh, and calculates a position Ptr situated backward from the rear end position Pr by a backward margin distance Ldr. The range specified by the positions Pth and Ptr is set to be the estimated train occupancy range.

(B) Train Position Correction Using Correction Coil 50

A train position correction process that utilizes the correction coil 50 is described below. The onboard system 20 corrects the train position Ph when the train 10 has passed through the correction coil 50. More specifically, the onboard system 20 communicates with the correction coil 50 to acquire the installation position (absolute position) of the correction coil 50, and corrects the train position (front end position) Ph based on the absolute position of the correction coil 50. The onboard system 20 also corrects the rear end position Pr and the estimated train occupancy range based on the corrected train position (front end position) Ph.

Figure 3:
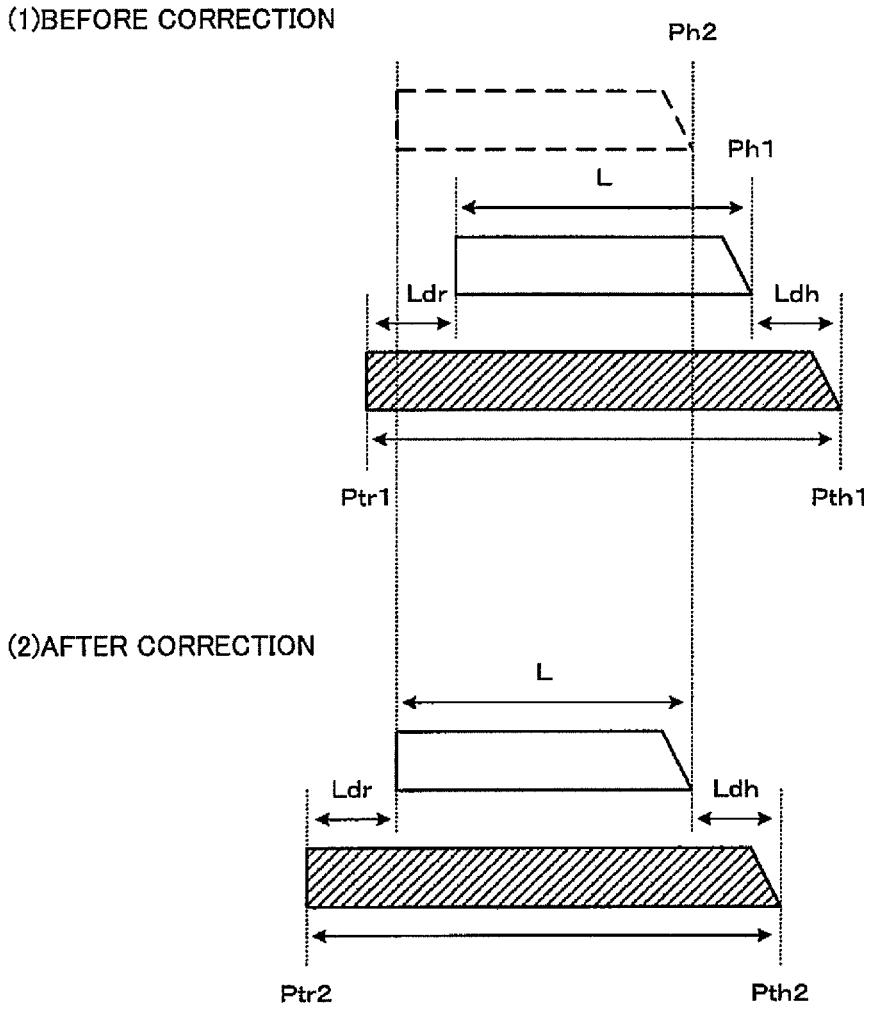
FIG. 3 is a view illustrating position correction that utilizes a correction coil.

FIG. 3 is a view illustrating the train position correction process that utilizes the correction coil 50. In FIG. 3, (1) indicates a state immediately before correction. In FIG. 3, the train figure indicated by the solid line indicates the measured train position, and the train figure indicated by the dotted line indicates the actual train position. As illustrated in FIG. 3, the measured train position (front end position) Ph1 precedes the actual front end position Ph2. The estimated train occupancy range is the range specified by the positions Pth1 and Ptr1.

(2) in FIG. 3 indicates a state in which the train position has been corrected after the train has passed through the correction coil 50. Specifically, the train position has been corrected (changed) so that the train position (front end position) Ph1 is shifted backward to the position Ph2. In this case, the estimated train occupancy range is also corrected (changed) so that the estimated train occupancy range is shifted backward to the range specified by the positions Pth2 and Ptr2 from the range specified by the positions Pth1 and Ptr1.

When the difference $\Delta Pt$ ($=|Ph1-Ph2|$) between the train position (front end position) Ph1 immediately before correction and the train position (front end position) Ph2 immediately after correction exceeds a predetermined value, it is determined than an abnormality has occurred, and a given process (e.g., emergency stop) is performed.

(C) Problem that May Occur Due to Position Correction

A problem that may occur due to the train position correction process that utilizes the correction coil 50 is described below. The ground system 30 determines whether or not each virtual block section is occupied by a train based on the estimated train occupancy range received from the onboard system 20. Therefore, when the train position Ph has been shifted backward by the position correction process, a situation may occur in which the train that has completely entered one block section enters the identical block section again (i.e., the occupancy state changes).

Figure 4:
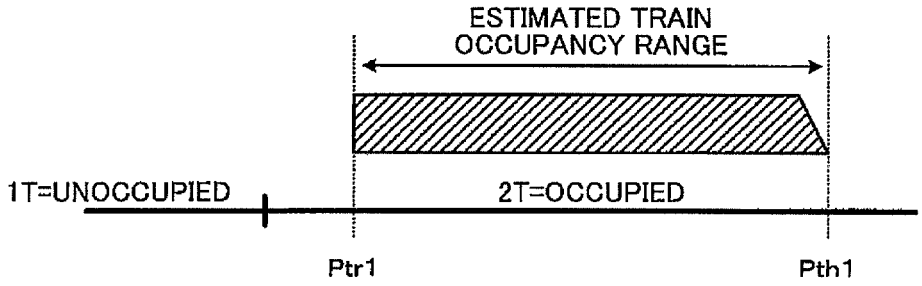
FIG. 4 is a view illustrating a problem that may occur due to position correction.
Figure 4:
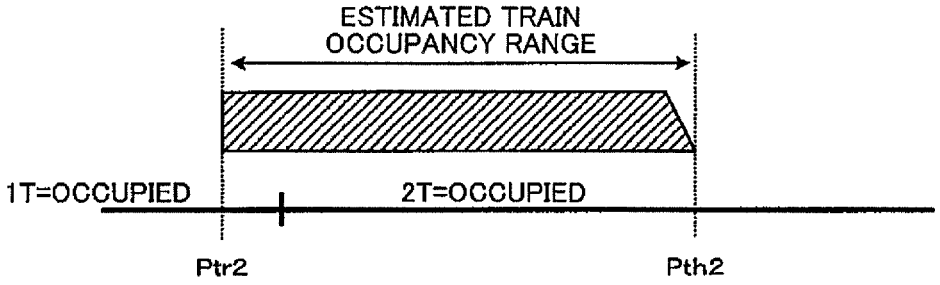

FIG. 4 is a view illustrating the problem that may occur due to the train position correction process. FIG. 4 illustrates an example of an occupancy determination process performed by the ground system 30. The occupancy determination process is performed based on the estimated train occupancy range. In FIG. 4, (1) indicates a state before correction. In this case, the estimated train occupancy range received from the onboard system 20 is the range specified by the positions Pth1 and Ptr1. The positions Pth1 and Ptr1 belong to the block section 2T. Therefore, the block section 1T is not occupied, and the block section 2T is occupied in this state.

For example, the onboard system 20 then corrects the train position so that the train position is shifted backward after the train has passed through the correction coil 50, and the estimated train occupancy range received from the onboard system 20 is specified by the positions Pth2 and Ptr2 (see (2) in FIG. 4) (i.e., the estimated train occupancy range has been shifted backward). In this case, the position Pth2 belongs to the block section 2T, and the position Ptr2 belongs to the block section 1T. Therefore, the block section 1T and the block section 2T are occupied in this state.

Specifically, the ground system 30 may determine that the block section 1T that has been detected to be unoccupied by the train 10 that travels forward is occupied by the train 10 again.

Although FIG. 4 illustrates an example in which the rear end position Ptr of the estimated train occupancy range is shifted backward across the boundary between the block sections, the same situation may also be applied to the front end position Pth.

According to one embodiment of the invention that can solve the above problem, when the train position Ph has been shifted backward due to the position correction process that utilizes the correction coil 50, the estimated train occupancy range based on the train position before correction is transmitted to the ground system 30.

Figure 5:
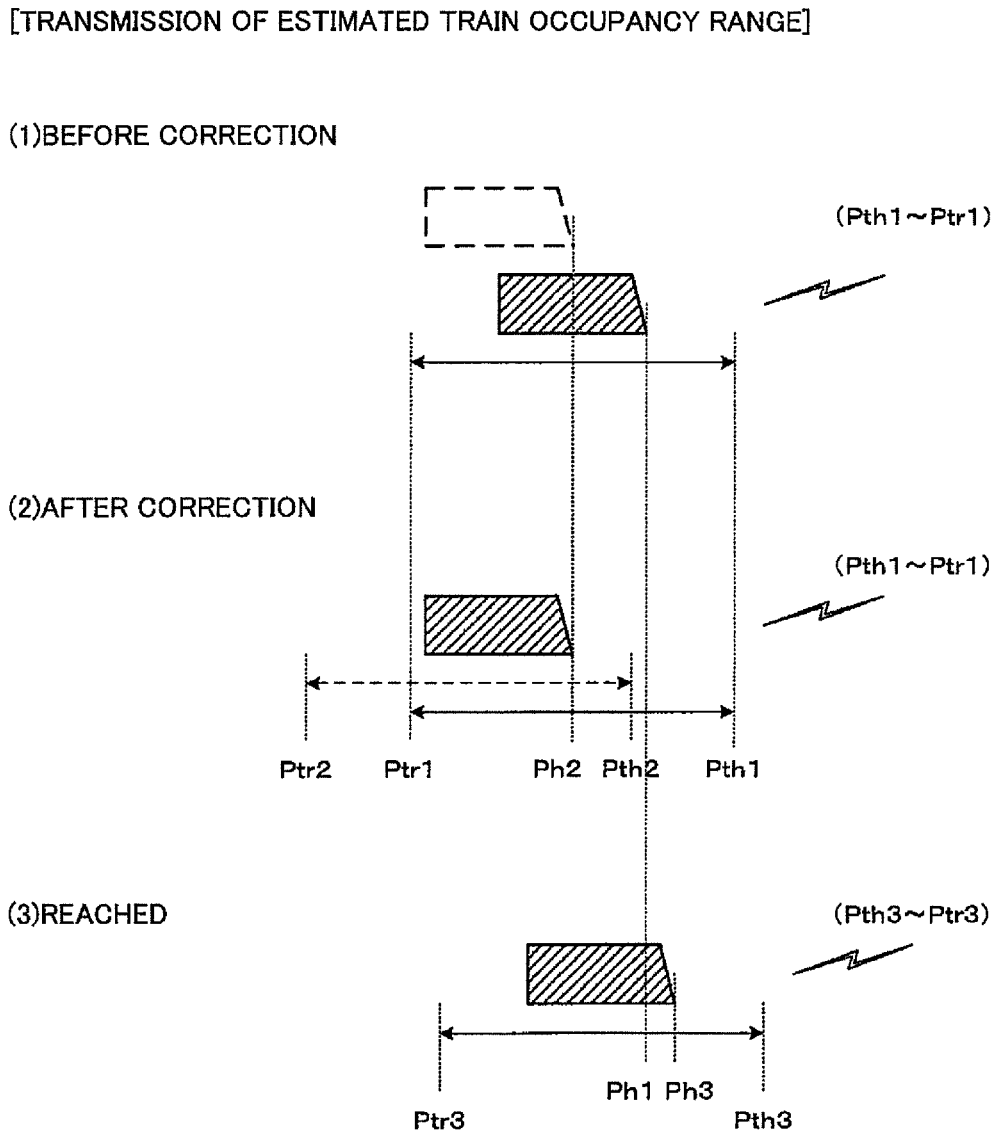
FIG. 5 is a view illustrating determination of an estimated train occupancy range.

FIG. 5 is a view illustrating the estimated train occupancy range transmitted from the onboard system 20. As indicated by (1) in FIG. 5, the train position Ph1 measured by the onboard system 20 precedes the actual train position Ph2. In this case, the onboard system 20 transmits the range specified by the positions Pth1 and Ptr1 based on the measured train position Ph1 as the estimated train occupancy range.

As indicated by (2) in FIG. 5, the train position Ph1 is corrected to the position Ph2 after the train has passed through the correction coil 50 (i.e., the train position Ph is corrected backward). In this case, the onboard system 20 transmits the range specified by the positions Pth1 and Ptr1 based on the train position Ph1 immediately before correction as the estimated train occupancy range instead of the range specified by the positions Pth2 and Ptr2 based on the train position Ph2 after correction.

The onboard system 20 continuously transmits the range specified by the positions Pth1 and Ptr1 based on the train position Ph1 before correction as the estimated train occupancy range until the latest measured train position Ph reaches the train position Ph1 immediately before correction. Specifically, the range specified by the positions Pth1 and Ptr1 is continuously transmitted to the ground system 30 as the estimated train occupancy range.

As indicated by (3) in FIG. 5, when the latest measured train position Ph has reached the train position Ph1 immediately before correction, the onboard system 20 transmits the range specified by the positions Pth3 and Ptr3 based on the latest train position Ph as the estimated train occupancy range.

Configuration

Figure 6:
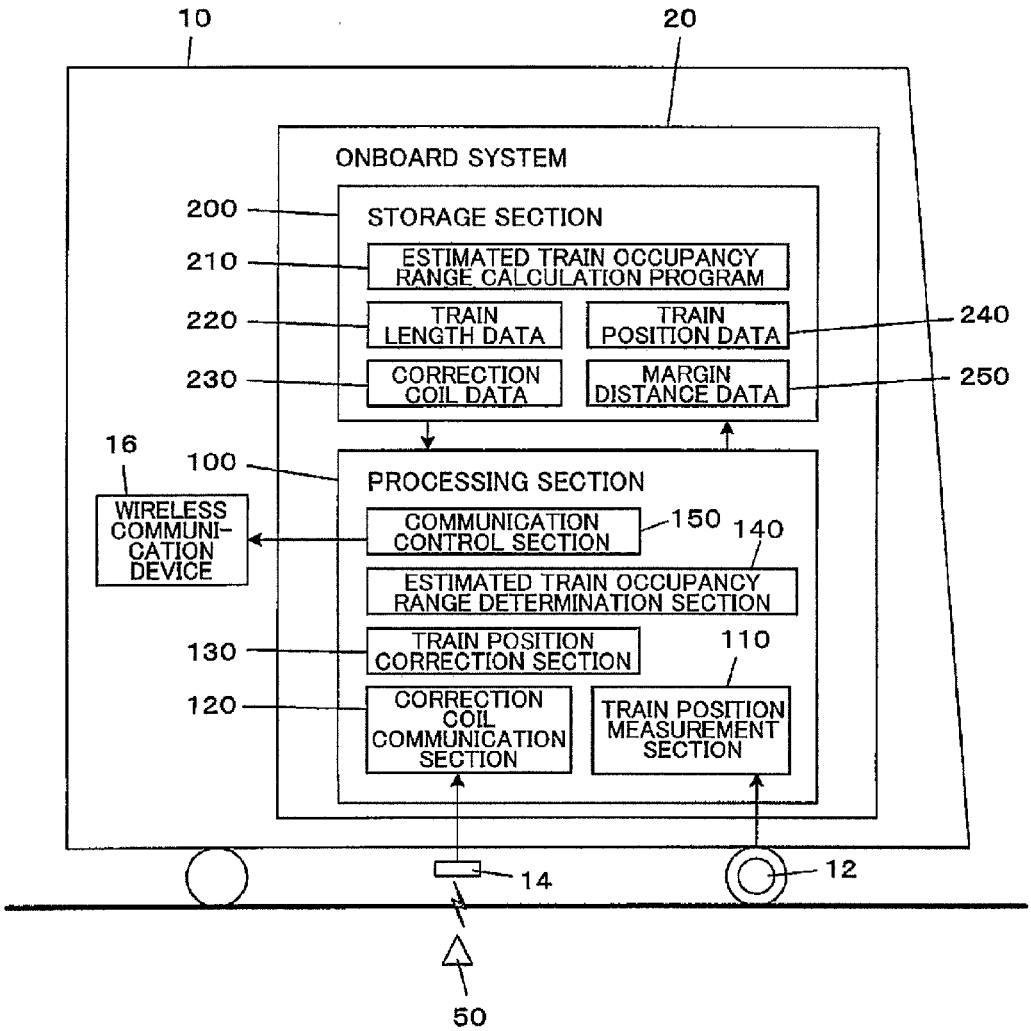
FIG. 6 is a view illustrating the configuration of an onboard system.

FIG. 6 is a view illustrating the configuration of the onboard system 20. As illustrated in FIG. 6, the onboard system 20 includes a processing section 100 and a storage section 200. Note that the configuration of the onboard system 20 illustrated in FIG. 6 is merely an example, and the onboard system 20 may further include an additional element. For example, the onboard system 20 may include a tacho-generator 12 and a receiver 14. The onboard system 20 may include an estimated train occupancy range determination device, and may be considered to be one type of estimated train occupancy range determination device.

The processing section 100 is implemented by a processor (e.g., CPU), for example. The processing section 100 controls the entire onboard system 20 based on a program and data stored in the storage section 200, data received via a wireless communication device 16, and the like. The processing section 100 includes a train position measurement section 110, a correction coil communication section 120, a train position correction section 130, an estimated train occupancy range determination section 140, and a communication control section 150.

The train position measurement section 110 measures the position of the train based on the measured rotational speed of the tacho-generator 12 attached to the axle.

The correction coil communication section 120 acquires a correction coil ID that identifies the correction coil 50 from the correction coil 50 via the receiver 14 that communicates with the correction coil 50 when the train passes through the installation point of the correction coil 50. The correction coil 50 and the receiver 14 communicate with each other via short-range wireless communication. The maximum communication range is about 20 cm to about 1 m, and an error of the train position due to the communication range can be disregarded.

The train position correction section 130 corrects the train position measured by the train position measurement section 110 based on the communication results of the correction coil communication section 120. More specifically, the train position correction section 130 identifies the correction coil 50 based on the correction coil ID acquired by the correction coil communication section 120 when the train passes through the installation point of the correction coil 50, and corrects the measured train position using the corresponding absolute position. Note that the relationship between the correction coil and the installation position is defined as correction coil data 230.

Figure 7:
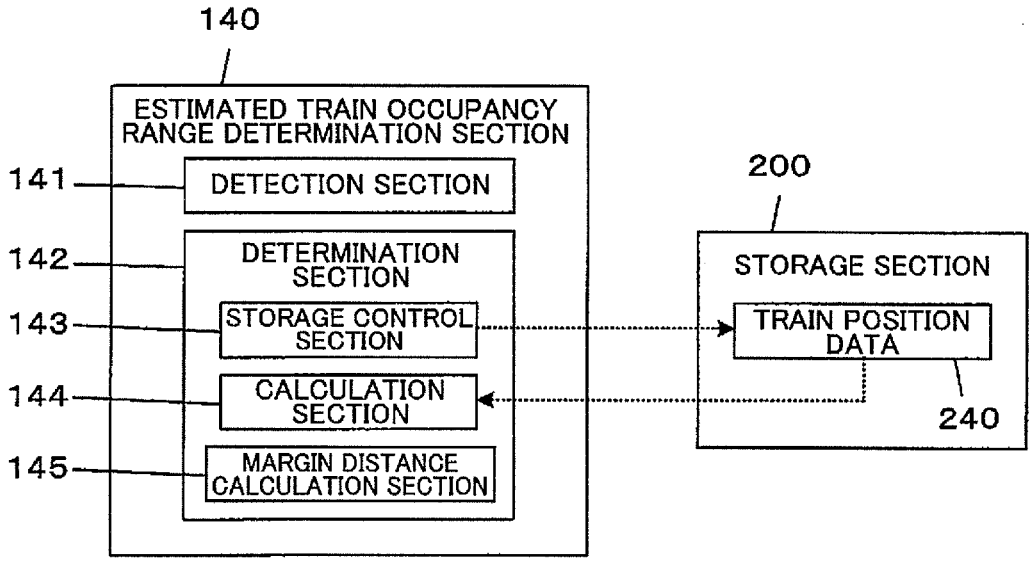
FIG. 7 is a view illustrating the configuration of an estimated train occupancy range determination section.

The estimated train occupancy range determination section 140 determines the estimated train occupancy range (in which the train may be present) using the train position. FIG. 7 is a view illustrating the configuration of the estimated train occupancy range determination section 140. As illustrated in FIG. 7, the estimated train occupancy range determination section 140 includes a detection section 141 and a determination section 142.

The detection section 141 detects whether or not the train position has been shifted backward based on a change in the train position. More specifically, the detection section 141 compares the train position immediately before correction with the train position immediately after correction when the train position correction section 130 has corrected the train position, and determines (detects) that the train position has been shifted backward when the train position immediately after correction is situated behind the train position immediately before correction.

The determination section 142 includes a storage control section 143, a calculation section 144, and a margin distance calculation section 145.

The storage control section 143 determines (controls) whether or not to store the latest train position in the storage section 200 as the train position data 240 corresponding to the detection result of the detection section 141. More specifically, the storage control section 143 stores the latest train position as the train position data 240 when the train position has not been shifted backward. The storage control section 143 does not update the train position data 240 when the train position has been shifted backward until the latest train position reaches the train position immediately before correction (i.e., the train position stored as the train position data 240). The storage control section 143 stores the latest train position as the train position data 240 when the latest train position has reached the train position immediately before correction.

The calculation section 144 calculates the estimated train occupancy range based on the train position Ph stored as the train position data 240. More specifically, the calculation section 144 determines the position situated backward from the train position Ph by the train length L to be the rear end position Pr. The calculation section 144 then calculates the position Pth situated forward from the train position Ph by the forward margin distance Ldh, and calculates the position Ptr situated backward from the rear end position Pr by the backward margin distance Ldr. The calculation section 144 calculates the range specified by the positions Pth and Ptr to be the estimated train occupancy range.

Note that the train length L is stored as train length data 220. The forward margin distance Ldh and the backward margin distance Ldr are calculated by the margin distance calculation section 145, and stored as margin distance data 250.

The margin distance calculation section 145 calculates the forward margin distance Ldh and the backward margin distance Ldr based on the travel distance after the train has passed through the installation point of the correction coil 50. More specifically, since it is considered that a measurement error of the train position measured by the train position measurement section 110 increases as the travel distance from the installation point of the correction coil 50 increases, the margin distance calculation section 145 calculates the forward margin distance Ldh and the backward margin distance Ldr so that the forward margin distance Ldh and the backward margin distance Ldr are proportional to the travel distance. The forward margin distance Ldh and the backward margin distance Ldr calculated by the margin distance calculation section 145 are stored as the margin distance data 250. Note that the forward margin distance Ldh and the backward margin distance Ldr may be calculated so that the forward margin distance Ldh and the backward margin distance Ldr increase as the elapsed time after the train has passed through the installation point of the correction coil 50 increases.

The communication control section 150 controls wireless communication with an external device (e.g., ground system 30) via the wireless communication device 16.

The storage section 200 is implemented by a storage device (e.g., ROM, RAM, or hard disk). The storage section 200 stores a system program that causes the processing section 100 to integrally control the onboard system 20, a program and data for implementing various functions, and the like. The storage section 200 is used as a work area for the processing section 100, and temporarily stores the results of calculations performed by the processing section 100, data received via the wireless communication device 16, and the like. In one embodiment of the invention, the storage section 200 stores an estimated train occupancy range calculation program 210, the train length data 220, the correction coil data 230, the train position data 240, and the margin distance data 250.

Process Flow

Figure 8:
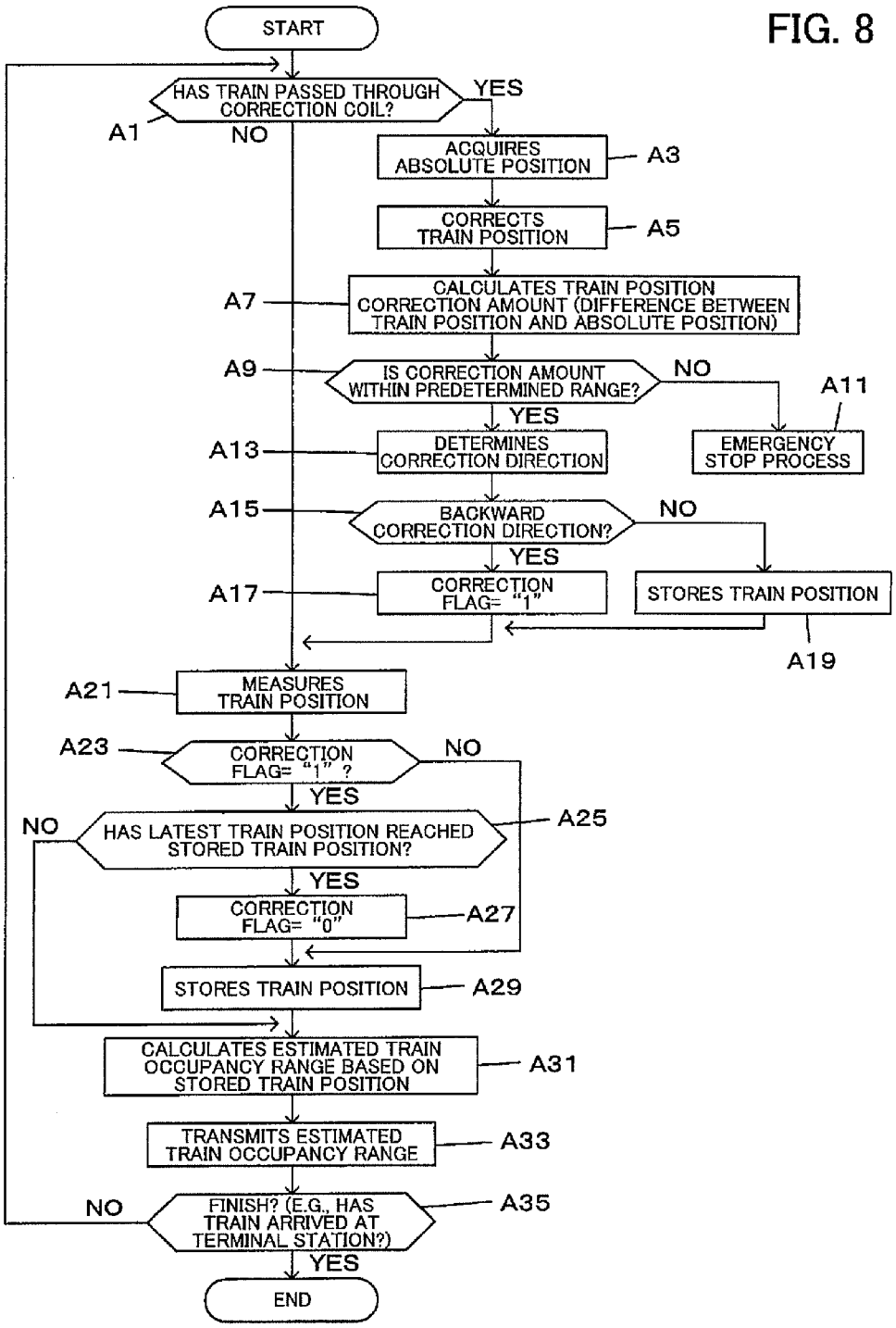
FIG. 8 is a flowchart illustrating an estimated train occupancy range calculation process.

FIG. 8 is a flowchart illustrating an estimated train occupancy range calculation process.

The estimated train occupancy range calculation process is implemented by causing the processing section 100 to execute the estimated train occupancy range calculation program 210.

When the receiver 14 has established communication with the correction coil 50 (i.e., when the train has passed through the installation point of the correction coil 50) (step A1: YES), the train position correction section 130 acquires the absolute position referring to the correction coil data 230 based on the correction coil ID acquired by the correction coil communication section 120 (step A3). The train position correction section 130 corrects the train position using the acquired absolute position (step A5).

The train position correction section 130 also calculates the train position correction amount (correction distance) that is the difference between the acquired absolute position and the train position when the train has passed through the correction coil 50 (step A7). When the correction amount exceeds a predetermined range (step A9: NO), it is determined that an abnormality has occurred, and an emergency process is performed (step A11). The emergency process includes a process that stops the train through emergency braking, for example.

When the correction amount is within the predetermined range (step A9: YES), the detection section 141 compares the train position immediately before correction with the train position immediately after correction to determine the train position correction direction (step A13). When the correction direction is the backward direction (step A15: YES), a correction flag that indicates backward correction is set to "1" (step A17). When the correction direction is not the backward direction (step A15: NO), the storage control section 143 stores the train position immediately after correction as the train position data 240 (step A19).

When the receiver 14 has not established communication with the correction coil 50 (step A1: NO), the train position measurement section 110 measures the latest train position based on the measured value of the tacho-generator (step A21).

When the correction flag has been set to "1" (step A23: YES), the storage control section 143 determines whether or not the latest train position has reached the train position immediately before correction that is stored as the train position data 240. When it has been determined that the latest train position has reached the train position immediately before correction (step A25: YES), the correction flag is set to "0" (step A27). The latest train position is then stored as the train position data 240 (step A29).

When the correction flag has been set to "0" (step A23: NO), the storage control section 143 stores the latest train position as the train position data 240 (step A29).

The calculation section 144 then calculates the estimated train occupancy range based on the train position stored as the train position data 240 (step A31). The communication control section 150 transmits the estimated train occupancy range to the ground system 30 (step A33).

Next, whether or not an estimated train occupancy range calculation process termination instruction has been issued (e.g., the train has arrived at the terminal station) is determined. When the termination instruction has not been issued (step A35: NO), the step A1 is performed again. When the termination instruction has been issued (step A35: YES), the estimated train occupancy range calculation process is terminated.

Advantageous Effects

According to the above embodiments of the invention, the onboard system 20 determines the train position by measuring the rotational speed of the wheel set, the axle, or the wheel that is detected using the tacho-generator or the like, determines the estimated train occupancy range (in which the train may be present) based on the train position, and transmits the estimated train occupancy range to the ground system 30. The onboard system 20 corrects the train position based on the results of communication with the correction coil 50 when the train has passed through the installation point of the correction coil 50. When the train position has been shifted backward as a result of correction that utilizes the correction coil, the onboard system 20 determines and transmits the estimated train occupancy range based on the train position immediately before correction until the latest train position reaches the train position immediately before correction, and determines and transmits the estimated train occupancy range based on the latest train position after the latest train position has reached the train position immediately before correction.

According to the above configuration, the estimated train occupancy range is not shifted backward as a result of correcting the train position when the train has passed through the correction coil 50. This prevents a situation in which the block section that has been detected to be unoccupied by the train 10 that travels forward is again detected to be occupied by the same train 10.

Modifications

The invention is not limited to the above embodiments. Various modifications and variations may be made without departing from the scope of the invention.

(A) Configuration of Estimated Train Occupancy Range Determination Section 140

Figure 9:
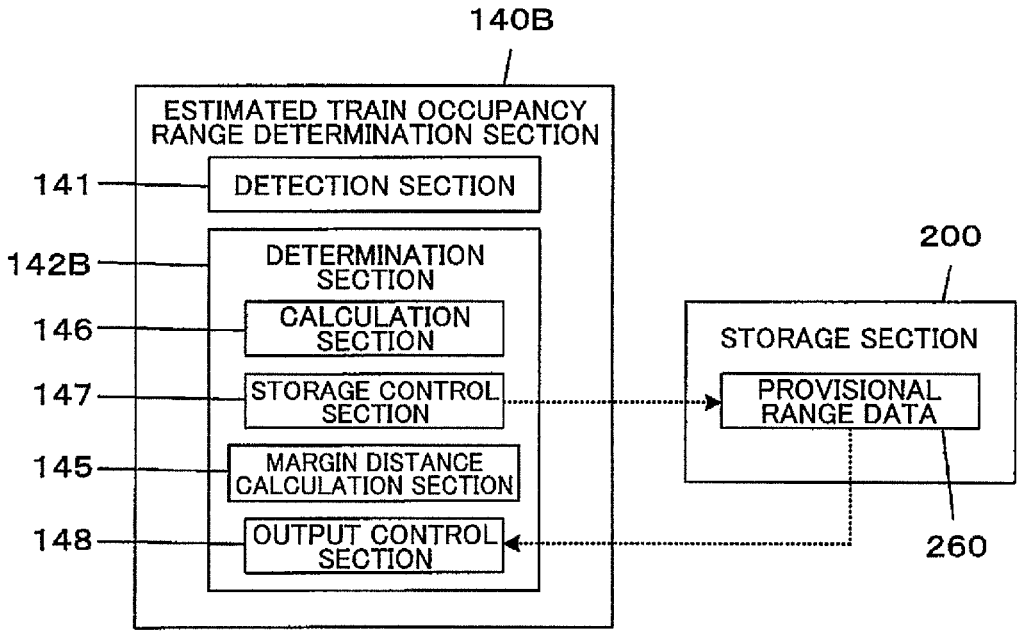
FIG. 9 is a view illustrating another configuration of an estimated train occupancy range determination section.

The estimated train occupancy range determination section 140 may be configured as illustrated in FIG. 9, for example. FIG. 9 illustrates another example of the configuration of the estimated train occupancy range determination section 140. As illustrated in FIG. 9, an estimated train occupancy range determination section 140B includes the detection section 141 and a determination section 142B. The determination section 142B includes a calculation section 146, a storage control section 147, the margin distance calculation section 145, and an output control section 148.

The calculation section 146 provisionally calculates the estimated train occupancy range based on the train position. The estimated train occupancy range thus calculated is referred to as "provisional range".

The storage control section 147 stores the provisional range calculated by the calculation section 146 in the storage section 200 as provisional range data 260 corresponding to the detection result of the detection section 141. More specifically, the storage control section 147 stores the calculated provisional range as the provisional range data 260 when the train position has not been shifted backward. The storage control section 147 stores does not update the provisional range data 260 when the train position has been shifted backward until the latest train position reaches the train position immediately before correction. The storage control section 147 updates the provisional range data 260 with the calculated provisional range when the latest train position has reached the train position immediately before correction.

The output control section 148 determines the provisional range stored as the provisional range data 260 to be the estimated train occupancy range, and outputs the estimated train occupancy range.

According to the above configuration, when the detection section 141 has detected that the train position has been shifted backward, the determination section 142B maintains (does not change) the estimated train occupancy range until the latest train position reaches the train position immediately before correction.

(B) Determination of Estimated Train Occupancy Range

Although the above embodiments have been described taking an example in which the onboard system 20 transmits the estimated train occupancy range determined based on the measured train position to the ground system 30, the ground system 30 may determine the estimated train occupancy range. In this case, the ground system 30 includes the estimated train occupancy range determination device.

(B-1) Calculation Section 144

When employing the above configuration, the ground system 30 may have the function of the calculation section 144. In this case, the onboard system 20 does not include the calculation section 144, and transmits the train position stored as the train position data 240 to the ground system 30 together with the margin distances Ldh and Ldr calculated by the margin distance calculation section 145. The ground system 30 calculates the estimated train occupancy range based on the train position and the margin distances Ldh and Ldr received from the onboard system 20.

(B-2) Estimated Train Occupancy Range Determination Section 140

Alternatively, the ground system 30 may have the function of the estimated train occupancy range determination section 140. In this case, the onboard system 20 does not include the estimated train occupancy range determination section 140, and transmits the latest train position to the ground system 30 while linking the latest train position to information that indicates the presence or absence of correction when the train has passed through the correction coil 50. The ground system 30 determines the estimated train occupancy range based on the received train position and information that indicates the presence or absence of correction.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. An estimated train occupancy range determination device that determines an estimated train occupancy range in which a train may be present, the train including a measurement section that measures a train position, a correction coil communication section that communicates with a correction coil when the train passes through an installation point of the correction coil, and a correction section that corrects the train position based on a communication result of the correction coil communication section, the estimated train occupancy range determination device comprising:

a processor that is configured to:

detect whether or not the train position has been corrected to a position in a backward direction relative to a train traveling direction; and determine the estimated train occupancy range using the train position, the processor maintaining the estimated train occupancy range when the processor has detected that the train position has been corrected to the corrected position until a latest train position reaches the train position immediately before the train position is corrected to the corrected position.

2. The estimated train occupancy range determination device as defined in claim 1, wherein the processor is further configured to:

store the train position in the storage device when the processor has detected that the train position has not been corrected to the corrected position, and not store the latest train position when the processor has detected that the train position has been corrected to the corrected position until the latest train position reaches the train position immediately before the train position is corrected to the corrected position; and calculate the estimated train occupancy range based on the train position stored by the processor.

3. The estimated train occupancy range determination device as defined in claim 1, wherein the processor is further configured to: calculate the estimated train occupancy range as a provisional range based on the train position; and store the provisional range when the processor has detected that the train position has not been corrected to the corrected position, and not store the provisional range when the processor has detected that the train position has been corrected to the corrected position until the latest train position reaches the train position immediately before the train position is corrected to the corrected position, and the processor sets the provisional range stored by the processor to be the estimated train occupancy range.

4. The estimated train occupancy range determination device as defined in claim 1, wherein the processor is configured to detect whether or not the train position has been corrected to the corrected position based on a change direction of the train position.

5. The estimated train occupancy range determination device as defined in claim 1, wherein the processor is configured to calculate a margin distance that allows a measurement error of the measurement section based on a travel distance after the train has passed through the installation point, and to determine a length of the estimated train occupancy range using the margin distance and a total length of the train.

6. An onboard system comprising:

a measurement section that measures a train position;

a correction coil communication section that communicates with a correction coil when a train passes through an installation point of the correction coil;

a correction section that corrects the train position based on a communication result of the correction coil communication section;

the estimated train occupancy range determination device as defined in claim 1; and a transmission control section that transmits the estimated train occupancy range determined by the estimated train occupancy range determination device to a ground system that manages a position occupied by a train.

7. An estimated train occupancy range determination method that determines an estimated train occupancy range in which a train may be present, the train including a measurement section that measures a train position, a correction coil communication section that communicates with a correction coil when the train passes through an installation point of the correction coil, and a correction section that corrects the train position based on a communication result of the correction coil communication section, the estimated train occupancy range determination method comprising:

detecting whether or not the train position has been corrected to a position in a backward direction relative to a train traveling direction;

determining the estimated train occupancy range using the train position; and maintaining the estimated train occupancy range when it has been detected that the train position has been corrected to the corrected position until a latest train position reaches the train position immediately before the train position is corrected to the corrected position.

* * * * *